United States Patent [19]

Nagai

[11] Patent Number: 4,652,159

[45] Date of Patent: Mar. 24, 1987

[54] PRINTER

[75] Inventor: Akio Nagai, Nagano, Japan

[73] Assignee: Kabushiki Kaisha Seiko Epson, Japan

[21] Appl. No.: 729,584

[22] Filed: May 2, 1985

[30] Foreign Application Priority Data

May 2, 1984 [JP] Japan ..... 59-88957
Mar. 7, 1985 [JP] Japan ..... 60-45450

[51] Int. Cl.[4] ..... B41J 19/50

[52] U.S. Cl. ..... 400/322; 400/320; 400/328; 318/607

[58] Field of Search ..... 400/306, 320, 322, 328; 318/607; 368/157

[56] References Cited

U.S. PATENT DOCUMENTS

| | | | |
|---|---|---|---|
| 3,408,547 | 10/1968 | Saeger | 318/607 |
| 3,548,282 | 12/1970 | Schiller | 318/606 |
| 3,828,168 | 8/1974 | O'Callaghan et al. | 318/607 |
| 3,836,756 | 9/1974 | Yammoto et al. | 318/608 |
| 3,906,327 | 9/1975 | O'Callaghan et al. | 318/607 |
| 3,963,971 | 6/1976 | Leenhouts et al. | 318/603 |
| 3,986,091 | 10/1976 | Quiogue et al. | 318/603 |
| 4,079,801 | 3/1978 | Dobson | 318/607 |
| 4,147,967 | 4/1979 | Aiena | 318/603 |
| 4,157,489 | 6/1979 | Tal | 318/607 |
| 4,180,766 | 12/1979 | Matula | 318/128 |
| 4,194,144 | 3/1980 | Reynolds | 318/318 |
| 4,203,679 | 5/1980 | Duerr et al. | 400/322 |
| 4,213,714 | 7/1980 | Jones et al. | 400/306 |
| 4,359,289 | 11/1982 | Barrus et al. | 400/322 |
| 4,376,914 | 3/1983 | Kimura | 318/607 |
| 4,404,510 | 9/1983 | Nakajima | 368/157 |
| 4,457,639 | 7/1984 | Nagai | 400/322 |
| 4,471,281 | 9/1984 | Vezumi et al. | 318/607 |
| 4,526,475 | 7/1985 | Moriya | 368/157 |

*Primary Examiner*—William Pieprz
*Attorney, Agent, or Firm*—Blum Kaplan Friedman Silberman & Beran

[57] ABSTRACT

A print timing circuit for a printer has a reciprocating carriage and at least one printing element mounted on the carriage. The print timing circuit includes a carriage controller for reciprocating the carriage and an encoder for detecting the speed of movement of the carriage and generating an encoder signal representative of the speed of movement of the carriage. An oscillator produces a print timing signal to control operation of the printing element. A frequency divider and comparator divides the encoder signal by N, where N is an integer. It also divides the print timing signal by M, where M is an integer. Then, it compares the phase relationship of the divided signals and provides an adjustment signal representative of the phase relationship of the divided signals to the oscillator. The oscillator is adapted to adjust the printing signal produced thereby in response to the adjustment signal so that the print timing signal causes the print element to print at a pitch equal to a fraction M/N of a reference pitch. In addition, another frequency dividing element can be utilized to arbitrarily designate one of the phase locked states for improved positional control of the print timing signals.

25 Claims, 20 Drawing Figures

PRINTER

BACKGROUND OF THE INVENTION

The invention is generally directed to printers and in particular to a serial dot printer with a character generator capable of generating characters of different pitches by generating different print timing signals.

Recently, high quality printing that approximates the quality of matrix font type printing has been achieved by increasing the number of dots used in a dot-matrix printer. As a result, a serial dot printer capable of dealing with various font types and a variety of character pitches is desired.

The print pitch of a serial dot printer is generally ten characters per inch. However, as the print quality improves, a printer capable of printing in a twelve and fifteen character per inch format, used in the matrix-font type printers is desired. One approach to this need is a printer system wherein a single printer has a number of character generators, each corresponding to a single print pitch rate. However, a printer of this type requires significant amounts of memory for each separate character generator, thereby increasing the cost of the printer.

Another approach to varying the print pitch between dots is to set the pitch of an encoder more finely than the actual print pitch and then frequency demultiplex the print timing signal to provide a print signal corresponding to a given print pitch. Still another approach has been to frequency divide the time interval between some pulses of the print timing system using a timer. Both of these approaches require a high resolution encoder which is a serious drawback in view of its high cost. In addition, accumulated errors increase the error in the location of the last print pitch position in the divided interval. Accordingly, there is a need for a printer having a print timing generator circuit which accurately generates print timing signals to generate characters at a variety of pitches without the need for high resolution encoders or large amounts of memory.

SUMMARY OF THE INVENTION

The invention is generally directed to a print timing circuit for a printer which has a reciprocating carriage and at least one printing element mounted on the carriage. The print timing circuit includes a carriage controller for reciprocating the carriage and an encoder for detecting the speed of movement of the carriage and generating an encoder signal representative of the speed of movement of the carriage. An oscillator produces a print timing signal to control operation of the printing element. A frequency divider and comparator divides the encoder signal by N, where N is an integer. It also divides the print timing signal by M, where M is an integer. Then, it compares the phase relationship of the divided signals and provides an adjustment signal representative of the phase relationship of the divided signals to the oscillator. The oscillator is adapted to adjust the printing signal produced thereby in response to the adjustment signal so that the print timing signal causes the print element to print at a pitch equal to a fraction M/N of a reference pitch. In addition, another frequency dividing element can be utilized to arbitrarily designate one of the phase locked states for improved positional control of the print timing circuit.

Accordingly, it is an object of the instant invention to provide an improved printer with a print timing generating circuit adapted to print characters at various pitches.

Another object of the invention is to provide an improved printer with a print timing generating circuit which is adapted to print characters of varying pitch by utilizing a phase-locked loop.

A further object of the invention is to provide a printer with a character generator which is able to print characters of different pitches and reduce positional error in printing.

Still another object of the invention is to provide an improved print timing generating circuit which is adjustable for varying pitches and accurately controls the movement of the carriage of a printer.

Yet another object of the invention is to provide a print timing generating circuit which adjusts for variations in pitch by frequency dividing a signal relating to the speed of the carriage and a print timing signal in a phase-locked loop.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

DETAILED DESCRIPTION OF THE PREFERRED EMBODIMENTS

To generate a print timing signal a rotary encoder or a linear encoder which converts the movement of the carriage into an electrical signal is used. The actual print timing is output at a fixed time interval in response to movement of the speed controlled carriage. The printer constructed in accordance with the invention utilizes these timing signals as an input to the print timing generating circuit. In particular, the printer includes a print itming control section with at least first and second frequency dividers, a phase difference detector, a filter and a variable frequency oscillator. The output signal from the encoder is frequency divided by a first frequency divider and applied to a phase difference detector. Likewise, the output signal of the variable frequency oscillator is frequency divided by a second frequency divider and applied to the phase difference detector. The phase difference detector outputs a phase difference signal which is applied through the filter to the variable frequency oscillator. The output signal of the variable frequency oscillator is used as the print timing signal. The encoder signal will be used as a reference value upon which the print timing circuit relies. To achieve a stable encoder signal a carriage motor driving circuit of high accuracy and stability is required. Such a circuit will be described below.

Figure 1:
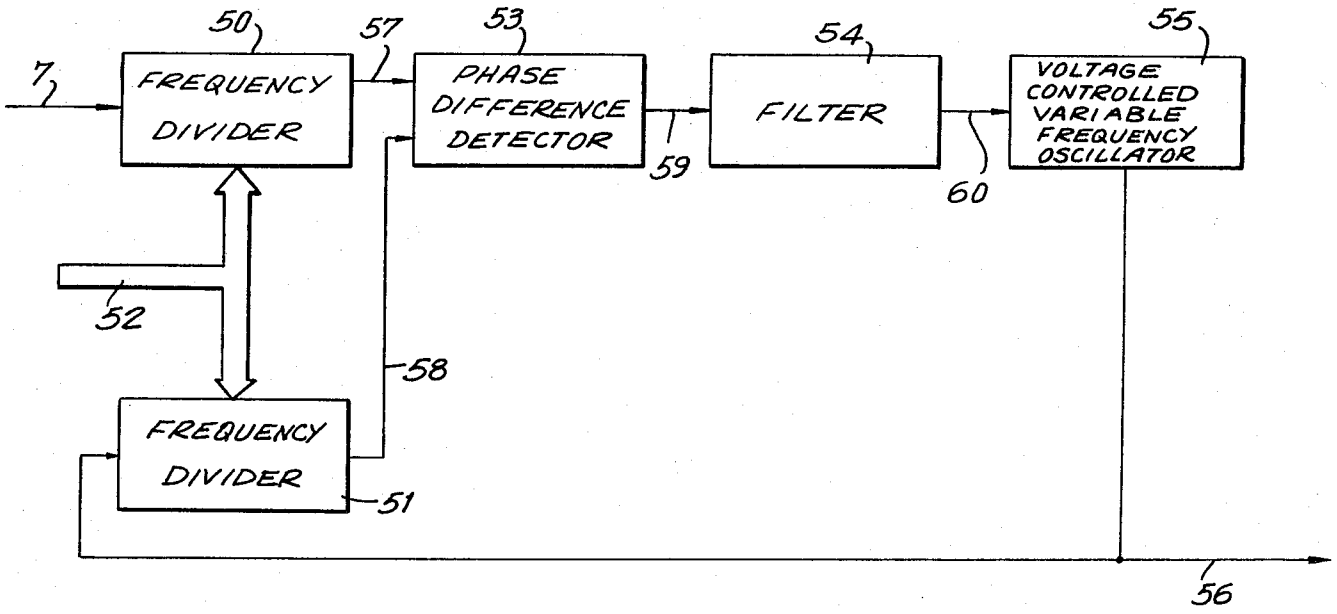
FIG. 1 is a block diagram of a print timing generating circuit for a printer constructed in accordance with the invention.

With this in mind, reference is made to FIG. 1 wherein a block diagram of a print timing generating circuit constructed in accordance with the invention is depicted. An encoder signal 7, generated by either a linear or a rotary encoder (not shown) is applied to a programmable frequency divider circuit 50 for dividing encoder signal 7 by N, based on a frequency division signal output 52 from a microprocessor unit (hereafter MPU), which controls the operation of the printer. Similarly, a second programmable frequency divider circuit 51 frequency divides the output signal of a voltage controlled variable frequency oscillator 55 by a factor of M. The value of M is based on a frequency divided value signal 52 transmitted from the MPU. The phase difference between the frequency divided output signals 57 and 58 is detected and converted into a pulse width signal 59 by a phase difference detector 53. A filter circuit 54 is used to convert pulse width signal 59 into an analog voltage signal 60. Filter circuit 54 is a low-pass filter. The analog voltage proportional to the phase difference is then applied to voltage control variable frequency oscillator 55 and supplied in the form of a print timing signal 56 to the MPU as well as the input of second programmable frequency divider circuit 51.

Encoder signal 7 is output in response to the movement of the printer's carriage and the print timing signal is locked at a frequency of the encoder signal divided by M/N. M and N are both integers and this allows for a variation in frequency of the encoder signal. The value of M/N is set based on the print pitch of the encoder. If the print pitch of the encoder selected is ten characters per inch, the ratio M/N is set to 6/5 if printing at twelve characters per inch is desired. Likewise, if fifteen characters per inch is desired, the ratio of M/N is set to 3/2.

The band width of filter circuit 54 is selected so as to be wide enough relative to the response frequency of the carriage driving system but also taking into consideration the stability and follow-up accuracy of the print timing circuit.

Figure 3A:
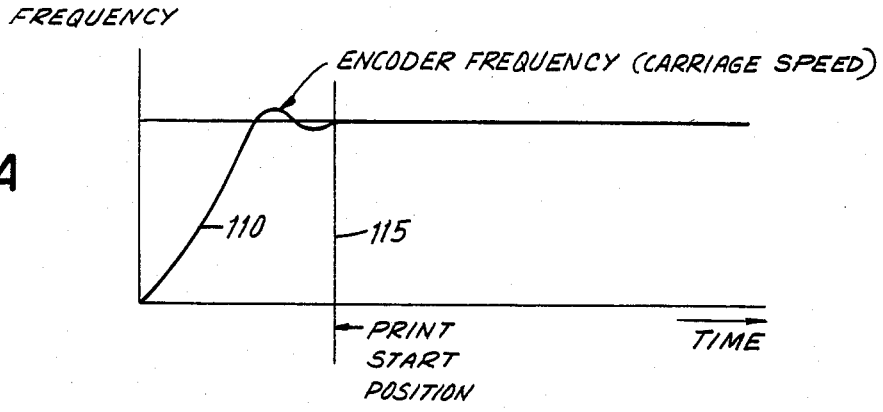
FIGS. 3A, 3B, 3C, 3D and 3E are graphs showing the response characteristics of the fundamental print timing generating circuit.

Reference is next made to FIGS. 3A–3E wherein the movement speed characteristics of the print carriage are shown. In FIG. 3A, curve 110 illustrates the output frequency of an incremental type encoder generated in response to the carriage displacement or speed. The output signal of the encoder will be referred to as a reference encoder signal because the functioning of the print timing circuit is predicted on a stable encoder signal. A circuit for producing carriage movement which generates the stable encoder signal is described below. Line 115 is the starting point of actual printing, that is, the carriage drive control system is designed so that carriage speed falls between a desired range at that point. Where the step input response characteristic of the print timing control circuit shown in FIG. 1 is designed to produce a curve 111 shown in FIG. 3B, the response relative to carriage speed 110 becomes like the curve 113 shown in FIG. 3D.

Figure 3B:
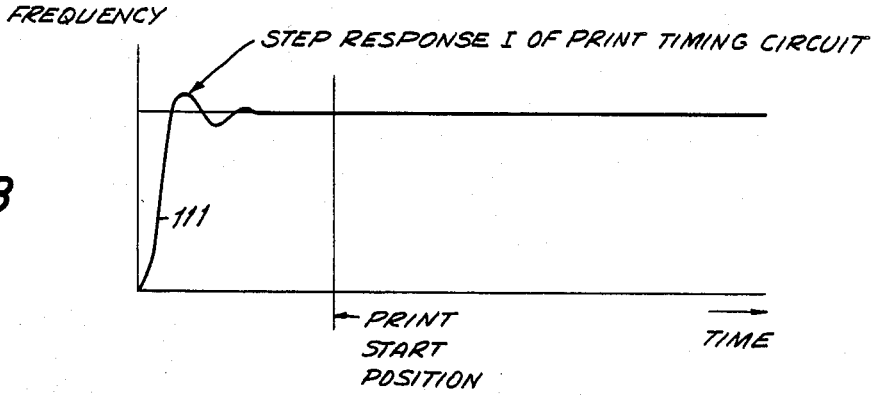
Figure 3C:
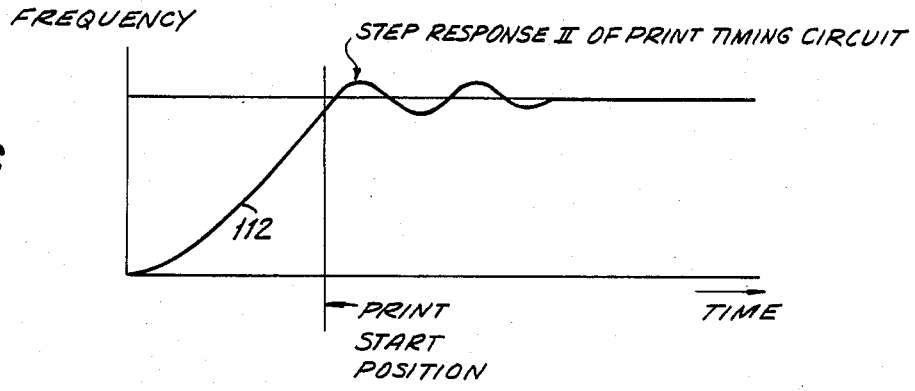
Figure 3D:
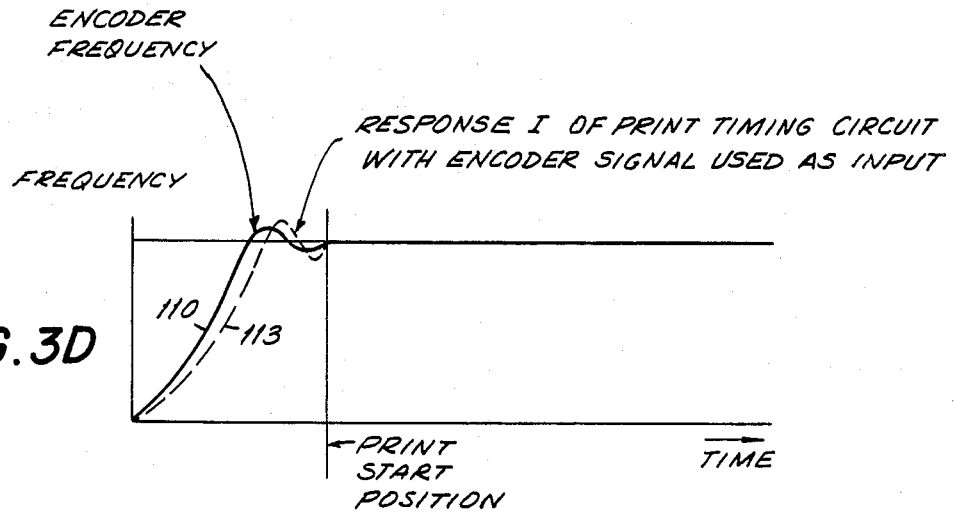
Figure 3E:
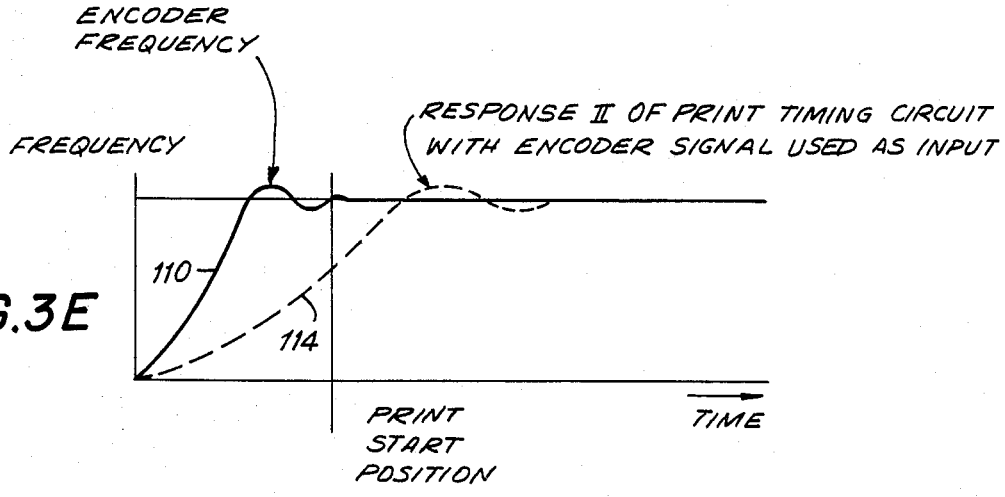

On the other hand, when the step input response characteristic of the print timing control circuit is designed so as to resemble curve 112 in FIG. 3C, the response relative to carriage speed 110 becomes like curve 114 shown in FIG. 3E.

Accordingly, in order to achieve an accurate print timing signal for the encoder at print start position 115, it is necessary to enhance the response of the print timing circuit in comparison to the response of the carriage drive control system as shown in FIGS. 3B and 3D. However, if the performance is overly enhanced, the stability in the steady state (after line 115) becomes deficient and an accurate print timing signal is not obtained.

The response characteristics of the print timing circuit can only be determined through consideration of the response characteristic of the carriage drive control system, the required degree of accuracy of print timing, the stability and the like. In this regard, for example, if it is desired to establish the print timing accuracy on the order of pitch accuracy plus or minus five per cent using a conventional carriage drive control system, the response characteristic must be increased by at least a factor of three or so. Other response characteristics of the print timing signal are determined on the basis of the frequency division numbers N,M, the oscillation range of the voltage control variable frequency oscillator and the time constant of the filter circuit.

Figure 2:
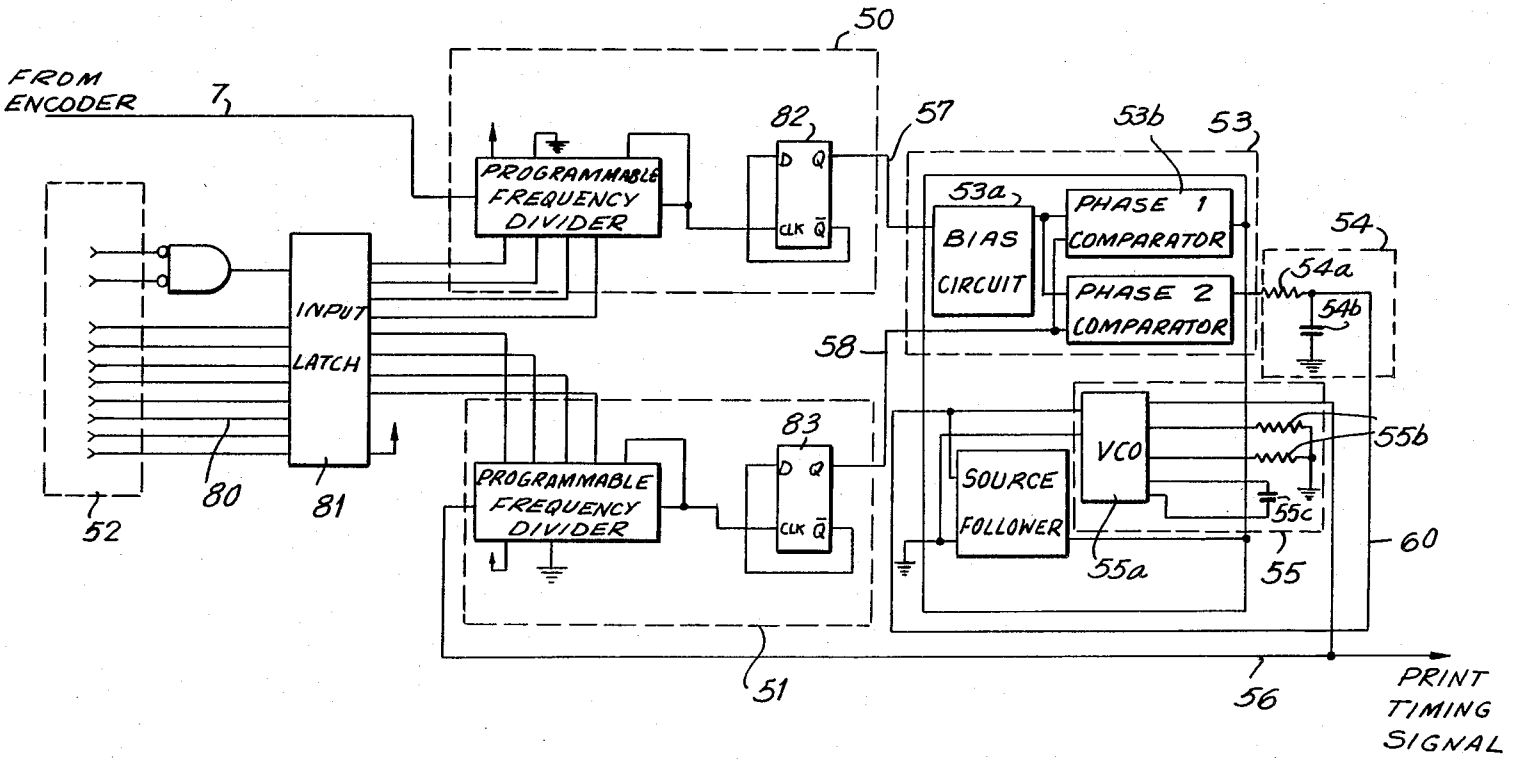
FIG. 2 is detailed circuit diagram of the print timing generating circuit illustrated in FIG. 1.

Reference is next made to FIG. 2 wherein a circuit diagram of the circuit of FIG. 1 is depicted. Frequency division ratio signal 52 is applied thorugh the MPU bus 80 to an input latch 81 which may be implemented in a preferred embodiment by an SN74LS273 chip. Frequency division value signal 52 is output to a 1/N divider 50 and a 1/M divider 51. The divider circuits may be implemented using a SN74LS193 programmable frequency divider circuit chip. The frequency division ratio signal 52 sets the programmable frequency divider circuits to divide the signals input to the dividers by the desired values. In addition to a programmable frequency divider, each of divider circuits 50 and 51 also include a connecting flip-flop, 82, 83 which further frequency divides the output of the 1/N and 1/M divided signals into pulses of an equal duty pulse width. As a result, frequency divided signals of 1/2N and 1/2M corresponding to the input signal 7 and 56 respectively are generated in dividers 50 and 51.

The outputs 57 and 58 of 1/N and 1/M frequency divider circuits 50, 51 respectively, are input to a phase difference detector 53. Phase difference detector 53 provides an output wave with a pulse width which varies depending upon the phase difference between the two inputs. The sign of the output wave changes in response to the lead/lag of the phase of the signals. In a preferred embodiment phase difference detector 53 includes a bias circuit 54A and a phase comparator circuit 53B.

Pulse width signal 59, which is the output of phase difference detector 53 is converted into an analog signal 60 by a filter circuit 54. Filter circuit 54 includes a resistor **54*a* and a capacitor 54*b***.

A voltage controlled variable frequency oscillator 55 receives the output signal 60 from filter circuit 54. Voltage controlled variable frequency oscillator 55 includes a VCO circuit **55*a* as well as biasing resistors and capacitors 55*b*, 55*c*, respectively. Bias circuit 53*a*, phase comparator 53*b*, VCO circuit 55*a* and biasing resistors and capacitors 55*b* and 55*c*** are available on a MC14046 chip.

The output signal 56 of voltage control variable frequency oscillator 55 is applied as an input to 1/M frequency divider circuit 51 thereby forming a closed loop. Output 56 is also the print timing signal.

If the frequency of encoder signal 7 is identified as $f_E$, the frequency of print timing signal 56 is defined as $f_T$ the frequency division of divider circuit 50 is set at 1/N and the frequency division value of frequency divider circuit 51 is set at 1/M, the above-described circuit satisfies the following relation:

$$f_E \cdot 1/N = f_T \cdot 1/M$$

As a result, the frequency $f_T$ of print timing signal 56 is locked at:

$$f_T = M/N \cdot f_E$$

Frequency division value numbers 1/N, 1/M can be set to any desired numbers in the programable dividing circuits by transmittal of a suitable signal along MPU bus 80 from the MPU. As a result, it is possible to perform printing of different dot pitches, such as Pica or Elite with a single character generator.

Figure 4:
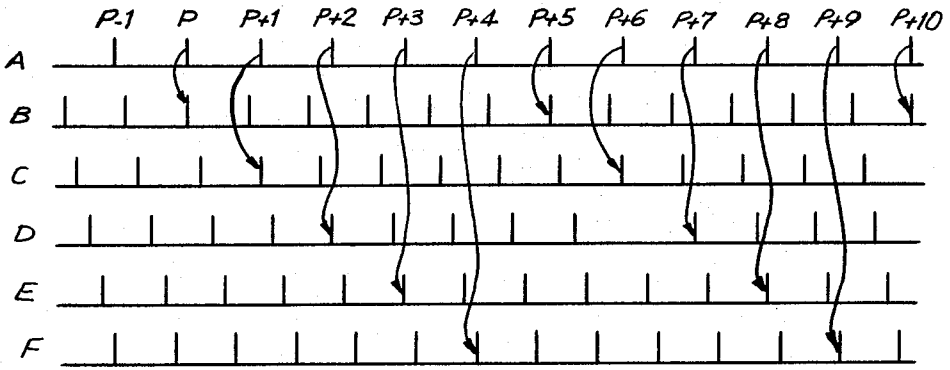
FIG. 4 is a timing diagram showing the relationship and phase between an encoder signal and a print timing signal.

Reference is next made to FIG. 4 wherein a timing diagram of the signal of the circuit of FIG. 2, wherein M/N=6/5 is depicted. The print timing generating circuit locks into one of five modes of the phase locked state (states B, C, D, E or F). For example, FIG. 4 illustrates all signals in the form of an edge-differentiated shape. The reference encoder signal is depicted as A in FIG. 4. In the B state, the encoder signals coincides with the print timing signal at carriage position P. After five pulses of the encoder signal and six pulses of the print timing signal, the two pulses again agree at position P+5. Through successive repetition of the above, the print timing signal is generated.

In the C state, the two pulses agree at position P+1 and again at position P+6. In the D state, the two pulses agree at positions P+2 and P+7, P+12, etc. In the E state, the two pulses agree at position P+3 and P+8 and successive five encoder signal pulse increments. Likewise, in the F state the pulses agree at positions P+4 and P+9 thereby generating the print timing signal.

Because phase lock states B through F are determined by the initial and transient states of frequency divider circuits 50 and 51, a particular phase relationship from among states B through F cannot be arbitrarily designated. Therefore, while division of the print timing signal is accurately performed, an error (interval) of a maximum of one encoder pulse measured by the absolute position scale can exist. In the above description it is assumed in FIG. 4 that the phase difference i.e., output signal 59 of phase difference detector 54 is zero in the phase locked state. However, this difference value is determined by the phase shift of the filter circuit and the loop gain of the whole print timing generating circuit and is not, as a matter of fact, always zero.

As a result, a print timing generating circuit constructed in accordance with the invention can also include a third frequency divider to arbitrarily designate one of the above described phase lock states B through F and output a more accurate print timing signal.

Figure 5:
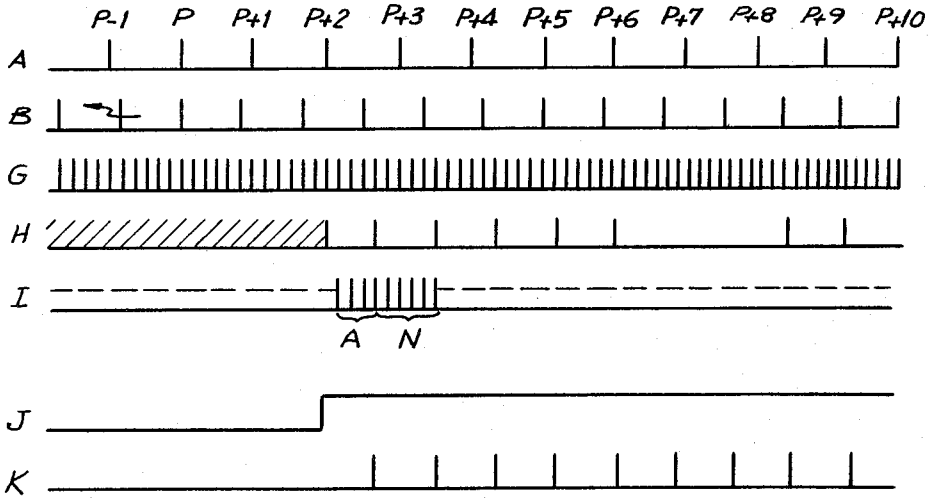
FIG. 5 is a second timing diagram showing the relationship and phase between an encoder signal and a print timing signal.
Figure 6:
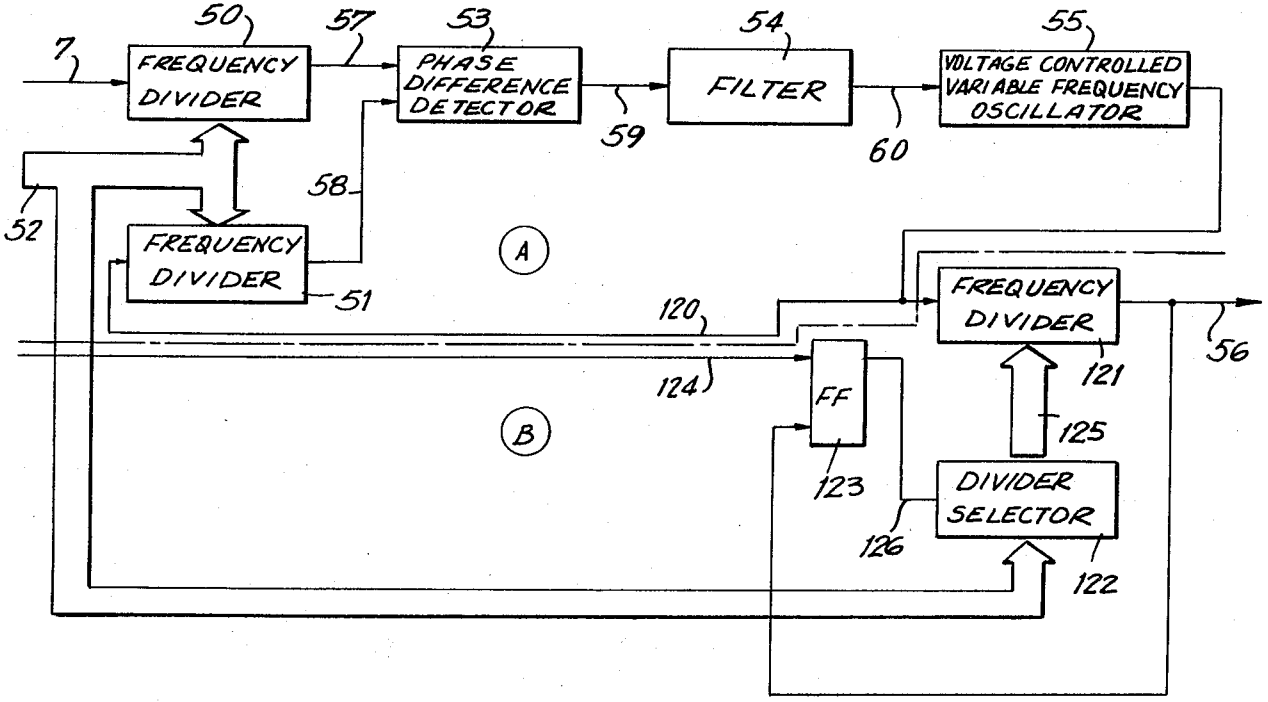
FIG. 6 is a simplified block diagram of a phase-locked type print timing generating circuit constructed in accordance with a second embodiment of the invention.

Reference is made to FIGS. 5 and 6 wherein a system including a third frequency divider to arbitrarily designate one of phase locked states B through F are depicted. FIG. 5 shows an example of the timing obtained in the system where the reference pitch of the print timing generating circuit is based on an encoder signal of ten characters per inch and the print timing signal is set at twelve characters per inch (i.e., the frequency division numbers are M=6 and N=5). Signal A in FIG. 5 represents the encoder signal which is used as a reference for the print timing signal. The timng signal is obtained at an accurate print position by locking the phase difference between the print timing signal B and the signal A to any of the locking states shown in FIGS. 4B through 4F. This is accomplished by changing the divisor of frequency divider circuit 51 from N to M×N. Another print timing signal is obtained which is N times (that is in number of pulses), the encoder signal A. This signal is shown as G in FIG. 5 (N=5). It is possible to discriminate between signal G and signal A by means of print control MPU which picks out only a needed print timing signal (pulse) from signal G. However, with this method,N repetitions of the print timing signal are applied to print controller MPU thereby increasing the complexity of processing and significantly lowering the processing throughput.

In contrast, the present invention solves the problem of designating a single phase locked state by dividing the print timing signal G with a third frequency divisor which divides the print timing signal by a different number so as to obtain print timing identical to that shown in FIG. 5B and arbitrarily sets the phase relationship. Similar adjustments can be made to obtain any of the five phase locked states desired.

Reference is made to FIG. 6 wherein a fundamental block diagram of the system is depicted. Part A of FIG. 6 is similar in structure to the block diagram of FIG. 1 and the operation is identical. However, the number by which programable frequency divider circuit 51 is set to divide by is set to 1/(M×N) through data bus 52 of the MPU. The output 120 of voltage control variable frequency oscillator 55 is frequency divided into a 1/X pulse signal by a programmable frequency divider 121. Two different values are inserted for X in programable frequency divider 121. Both of these frequency division ratios are applied to programmable frequency divider 121 through a data bus 125. The two values are 1/A and 1/N which are present on data bus 52 of the MPU. One of these two dividing ratios is selected by a data selector circuit 122. Dividing ratio selection changing is implemented by output signal 56 with a flip-flop 123. A set signal 124 from the MPU is applied to the flip-flop at an arbitrary encoder position (i.e., P+1 or P+2, etc.). As a result of set signal 124, flip-flop 123 is caused to enter the set state where the frequency dividing ratio of programmable frequency divider 121 is set to 1/A. Thereafter, after the output pulse, shown as signal G in FIG. 5, of the voltage controlled variable frequency oscillator 55 appears A times (a total of A pulses), prints timing signal 56 is output. The output of print timing signal 56 causes flip-flop 123 to change to the reset state, causing the output of data selector circuit 122 to switch the frequency division ratio of frequency divider 121 from 1/A to 1/N, and from this time on print timing signal 56 is output each time N pulses on signal G of FIG. 5 are produced. Signal H of FIG. 5 illustrates the waveform of output print timing signal 56 which is the output 120 of voltage control variable frequency oscillator 55.

Specifically, signal H of FIG. 5 represents the case where N=5, M=6, A=4, and the circuit is acutated at encoder position P+2. Although the foregoing description assumes that the frequency division ratio of the third frequency divider 121 is 1/N, the N is not necessarily the N used for the first frequency divider, or, by selecting an integral multiple of N it is possible to more finely compensate for the position of the print timing signal.

Now, the process of computing the frequency division ratio 1/A is described. The print start position is computed by taking the count P of the encoder signal as a starting point or base. Generally, the pitch of the encoder is set to correspond to the minimum interval between dots in a ten character per inch print mode. For convenience, the following description will assume that the pitch of the encoder signal is so set.

First, the values M and N are selected to give the appropriate print pitch. Then, the print start position is computed through conversion based on the given print pitch, the resultant value being defined as being as R. In converting this value R into a count of the encoder, the following relation is obtained:

$$P=R\times N/M$$

Where P is the print start position with the encoder being taken as a base or starting value. The value P is not necessarily an integer. Therfore, the print position will not be precisely determined on some occasions. As a result, an additional computation is performed in accordance with the following equation to obtain the desired integer portion:

$$P'=Int(R\times N/M)$$

Where Int(x) is the integer function which returns an integer value equal to x minus fractional portion. As an example, if X=5.75, Int(5.75)=5. As is apparent from FIG. 5 the output value before frequency division of the print timing signal in the locked state is M times the encoder signal, i.e., M-times pulses have been output. Then, for conversion, the fraction P'' of the above computation ($P''=(R\times N/M)-P'$) is multiplied by M to become an integral number. The resultant value is the frequency division ratio number A:

$$A=[(R\times N/M)-P']\times M$$

According to one simplified computation process, the value R is first multiplied by N. Next, the resultant value is divided by M in an integer version into the quotient P' with the remainder A. When the encoder reaches location P', the frequency division ratio of programmable frequency divider 121 is set to 1/A and, then switched to 1/N in response to a first output of the print timing signal 56 to obtain print timing at the given position.

The foregoing process of computation is for the case where printing takes place in the increasing direction of the encoder. On the other hand, when printing is to be performed in the decreasing direction of the count of the encoder in a bi-directional printing system, 1 (one) is added to P' to get P. In addition, in place of the above described remainder A, a new value A' equal to M - A is used. That is, the value 1/A' is set in the system at position P''', as in the above case. Further, by adding an appropriate offset value to each of P', P''', A, A' it is possible to compensate for any print discrepancies in the bi-directional printing system.

Figure 7:
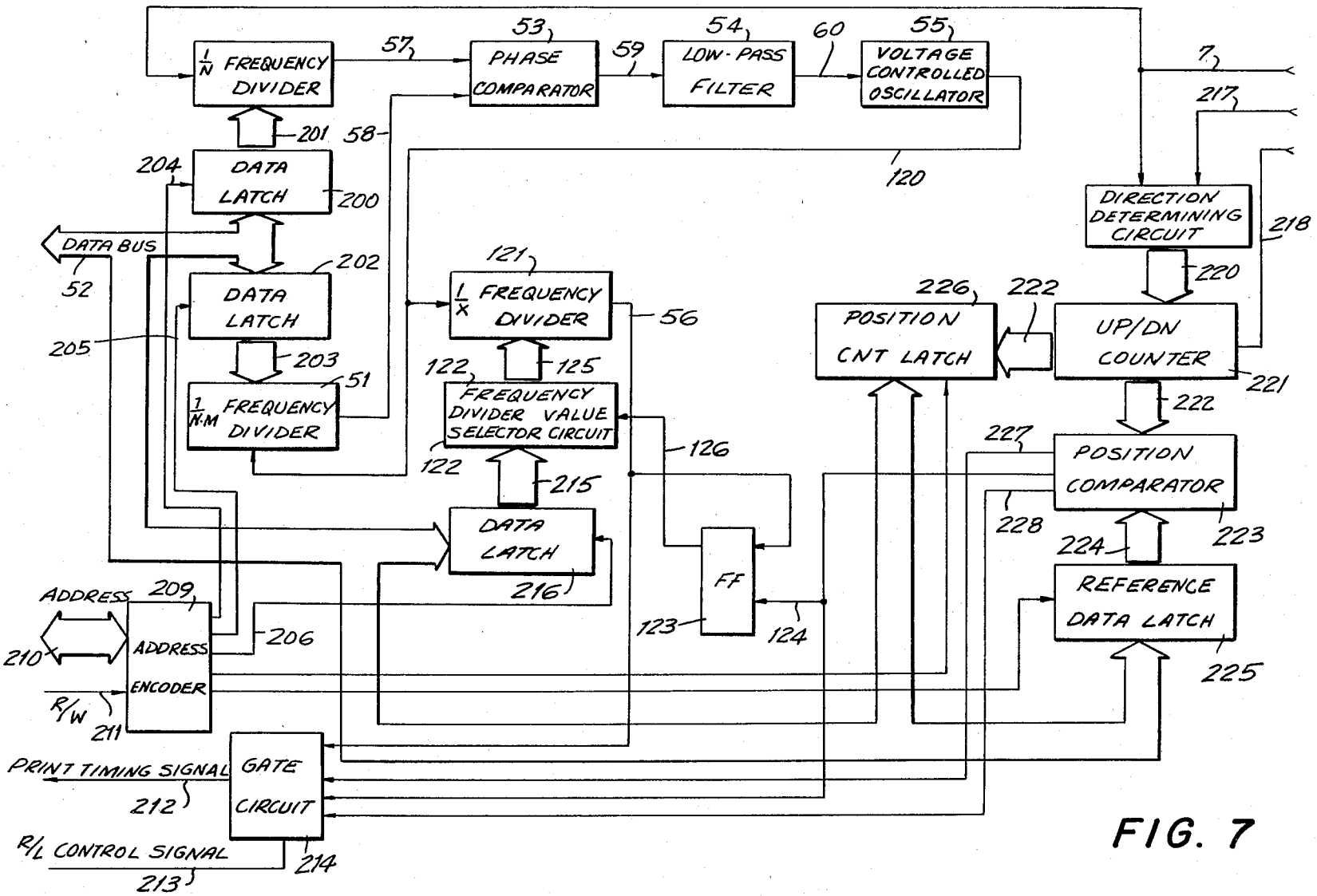
FIG. 7 is a detailed block diagram of the block diagram of FIG. 6.

Reference in now made to FIG. 7 where a circuit diagram of the circuit of FIG. 6 is depicted. The lead/-lag of phase between phase-A reference encoder signal 7 and a phase-B reference encoder signal 217 differing 90° in phase from signal 7 is discriminated by a direction discriminator 229 to cause addition/substraction (up/-down counting) of a position counter 221. The result of the arithmetic operation is treated as the value P. The count 222 of counter 221 is sent to a position comparator 223 and compared with a reference position value 224 sent from the MPU. A reference position latch 225, which temporarily stores the data sent through data bus 52 from the MPU now stores either P' or P''' and outputs this as the reference position value 224. A position counter latch 226 temporarily stores the count 2 of position counter 221 in response to a command by the MPU and outputs this value onto data bus 52, thereby permitting the MPU to read out the carriage position of the printer.

A data latch 200 is used to temporarily store the frequency division value (N) from the MPU and outputs it as the frequency divide value signal 201 to frequency divider 50. Similarly, a data latch 202 is used to temporarily store the frequency divide value (M×N) from the MPU and output it as the frequency divide value signal 203 to frequency divider 51.

A data latch 216 temporarily stores the frequency divide values (A or A', and N) from the MPU and outputs them as a frequency divide value signal 315 to frequency divide value selector circuit 122. In turn, frequency divide ratio selector circuit 122 is switched from one of values A and A' and N and one of these values is applied to frequency divider 121 as a frequency divide ratio 125 under the control of a flip-flop 123.

Address decoder 209 outputs latch selections signal 204 through 208 on the basis of an address signal 210 and an R/$\overline{W}$ signal 211 to cause the data transfer operation between the MPU and the respective data latches. Output signals of the position comparator 223 are a coincidence signal (P=R) 124, a first non-coincidence signal (P>R) 227, and a second non-coincidence signal (P<R) 228. These signals are derived from the position count 222 (P) and the position reference value 224 (R). On the basis of these three signals and a carriage moving-direction signal (R/$\overline{L}$), a gate circuit 214 selects certain pulses (after the position reference value has appeared) among the print timing signals 56 being generated and outputs them as a print timing signal 212 to the MPU. The gate signal in the above operation is illustrated as signal J in FIG. 5 and print timing signal 212 output to the MPU is illustrated on line K of FIG. 5.

The operation of the remaining components in FIG. 7 operate as described above with respect to earlier figures. Therefore, no further description of them is provided.

Figure 8:
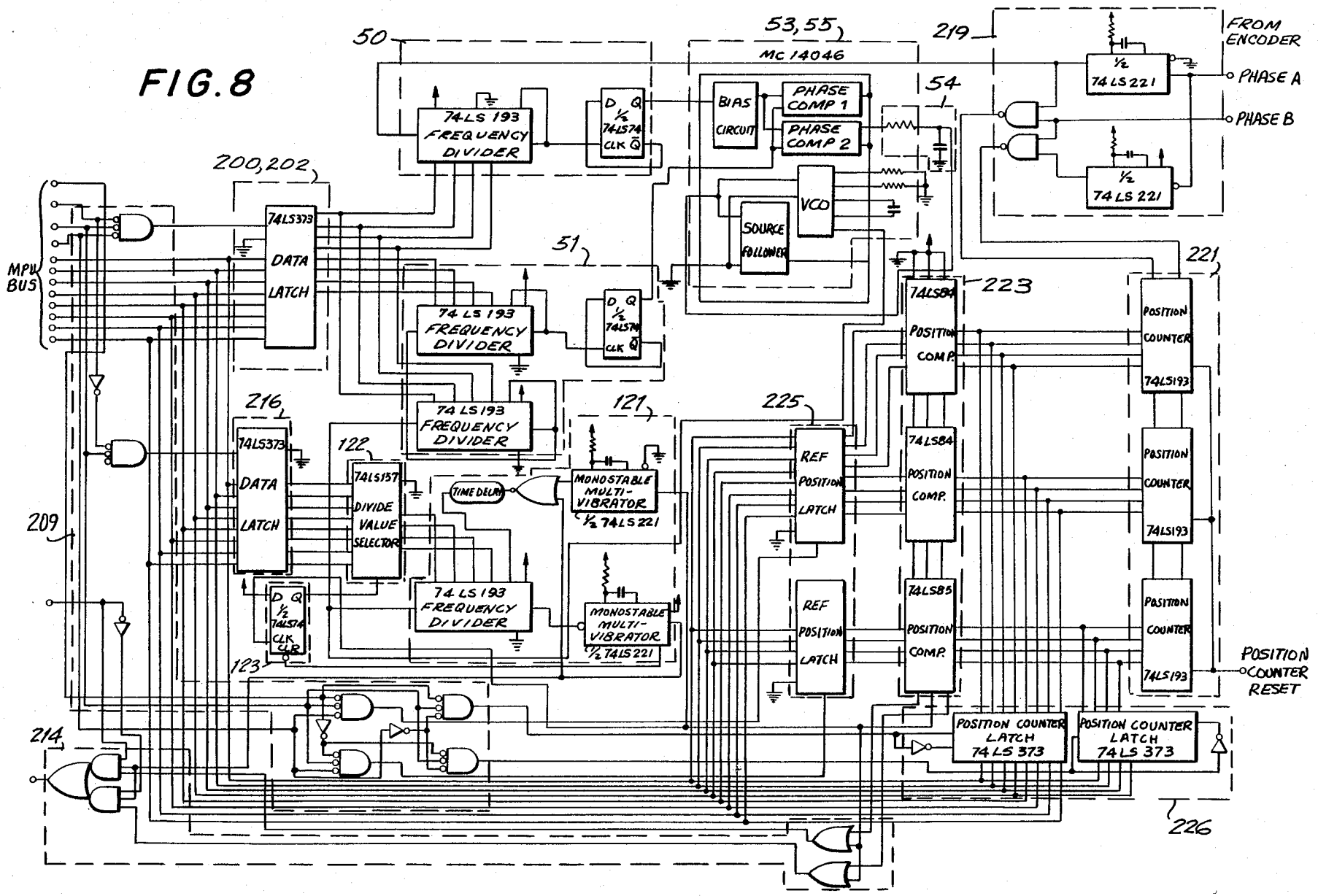
FIG. 8 is circuit diagram of the circuit shown in FIG. 7.

Reference is next made to FIG. 8 wherein a detailed circuit diagram of the circuit shown in FIG. 7 utilizing TTL-IC elements is depicted. In the drawing, data latches 200 and 202 are each configured for temporarily storing two data words of four bits each. Similarly, data latch 216 is configured to latch two data words of four bits each. The illustrated circuit is designed to deal with a printer having up to 4,096 carriage positions (twelve bits) and has an input data bus of eight bits. As a result, position counter 221 is able to handle twelve bits and each of reference position data latch 225, position counter latch 226 and position comparator 223 can also handle twelve bits. Direction determining circuit 219 is the phase discriminating circuit from differentiating the rising/falling edge of reference encoder phase-A signal 7, ANDing the resultant signal with the phase-B signal 217 to separate the pulses of each direction and send the result to position counter 221. Address decoder 209 is an AND circuit for generating a chip selection signal for each latch from the address signals A0, A1, $\overline{CS}$ and $R/\overline{W}$ of the MPU. Frequency dividing circuit 50 divides the frequency by a factor of 1/(2N), similarly, frequency divider circuit 51 divides the frequency signal by $1/(N \times M \times 2)$. Likewise, frequency divider circuit 121 divides the signal by a factor of 1/N or 1/A. A monostable multivibrator (in a preferred embodiment data chip 74LS221), on the output side of frequency divider 121 assures a certain pulse width of the output. Gate circuit 214 is made of AND and OR gate which, in response to the value of carriage moving-direction signal $R/\overline{L}$, switches its output among the comparison values ($P>R$, $P=R$, $P<R$), derived from the outputs of position counter 221 and position reference value latch 225. That is, when $R/\overline{L}$ is one, the timing pulses output to the MPU in the incremental direction of the counter or under $P>R$ and $P=R$. Otherwise, when the $R/\overline{L}$ signal is zero, the timing pulse is output to the MPU in a direction opposite the incremental direction of the counter or where $PW<R$ and $P=R$. In addition, a position counter reset signal 218 is used to reset the position counter when the carriage is at the left-end.

Although the circuit of FIG. 8 has been depicted as being composed of ICs of the LS-TTL series and CMOS type, the circuit can be formed of any elements having similar functions, such as standard TTL series and/or CMOS or similar components.

In addition, the filter circuit may be a higher order filter and the integrating circuit may be one type of low-pass filter.

In addition, although the above described embodiment includes a voltage control variable frequency oscillator 55, this oscillator 55, filter circuit 54, phase difference detector 53 and other components can be replaced by numerical control type units and all phase difference detection processes and the like can be achieved by use of digital, numerical control system elements.

In FIG. 7, frequency dividers 50, 51, which output signals 57, 58, respectively, to phase difference detector 53 have frequency division ratios 1/N, 1/N+M), respectively. Because 1/N is common to both of frequency dividers 50 and 51 it can be eliminated. By eliminating 1/N, the frequency division ratios of frequency dividers 50, 51 are 1 and 1/M, respectively. Since it is unnecessary to have a frequency divider to divde by a frequency division ratio of 1, frequency divider 50 can be eliminated from the diagram of FIG. 7. Such a block diagram is shown in FIG. 15.

Figure 15:
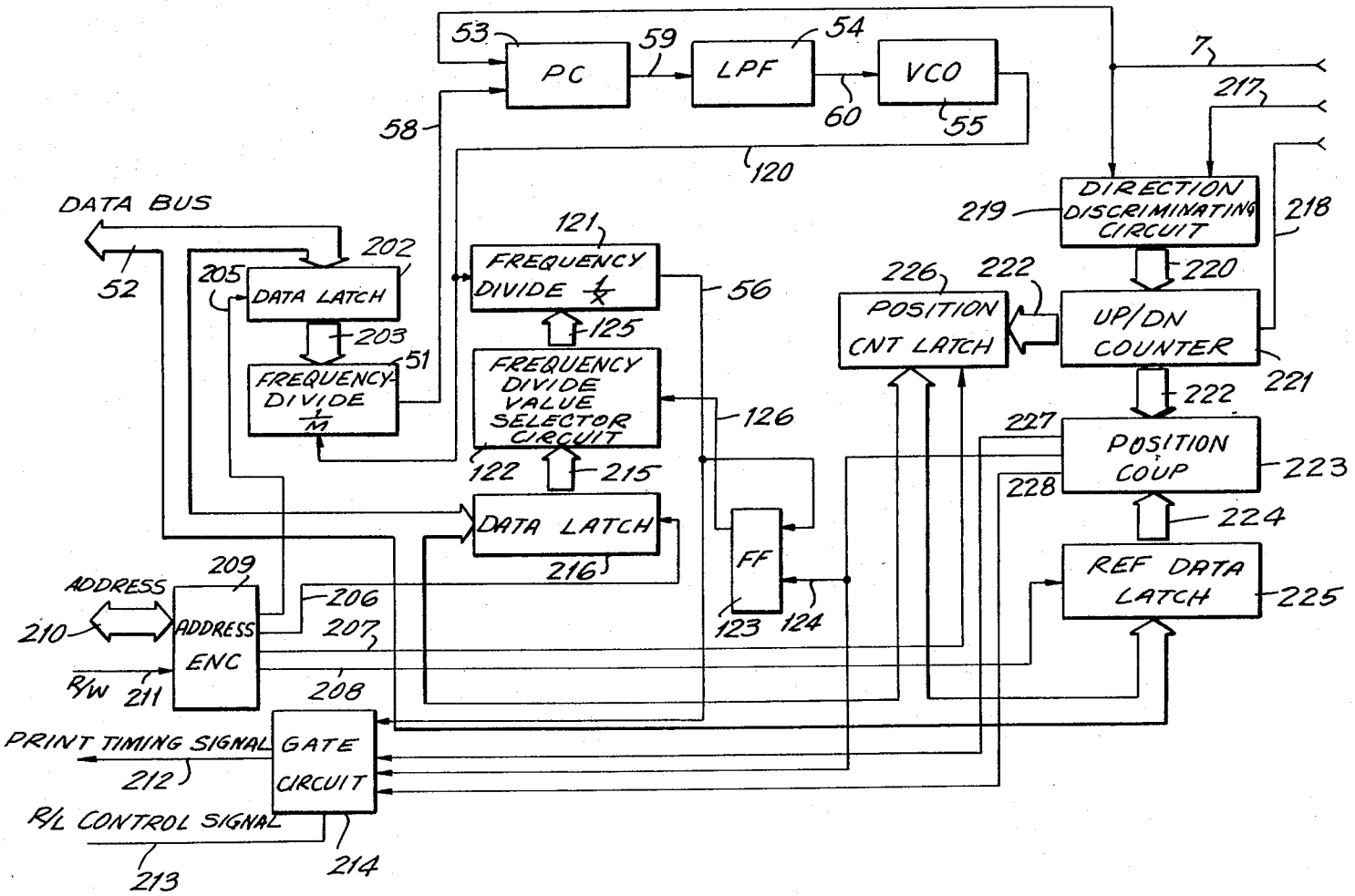
FIG. 15 is a detailed block diagram of the block diagram of FIG. 6, wherein the first frequency divider circuit is eliminated.

Reference is made to FIG. 15 where the circuit of FIG. 7 excluding frequency divider circuit 50 and having a frequency divider circuit 51 with a frequency division ratio of 1/M is depicted. The circuit of FIG. 15 has the same effect as does the circuit shown in FIG. 7.

The print timing generating circuit described above is dependent upon a stable carriage drive control system which achieves a high degree of accuracy with fluctuations and speed and stability minimized to an acceptable level. In view of the foregoing requirements for the successful implementation of the above described print timing generating circuit a serial dot printer with a high performance carriage control device having enhanced accuracy at low cost which utilizes a DC motor in the carriage dirving system is preferred.

Such a motor controller for a printer carriage which operates with a high degree of accuracy and stability is described in U.S. Pat. No. 4,457,639. The description of the motor controller in U.S. Pat. No. 4,457,639 is incorporated by reference herein. However, a brief discussion of the operation of the motor controller used in connection with the print timing generating circuit in the printer constructed in accordance with the invention follows.

Figure 10:
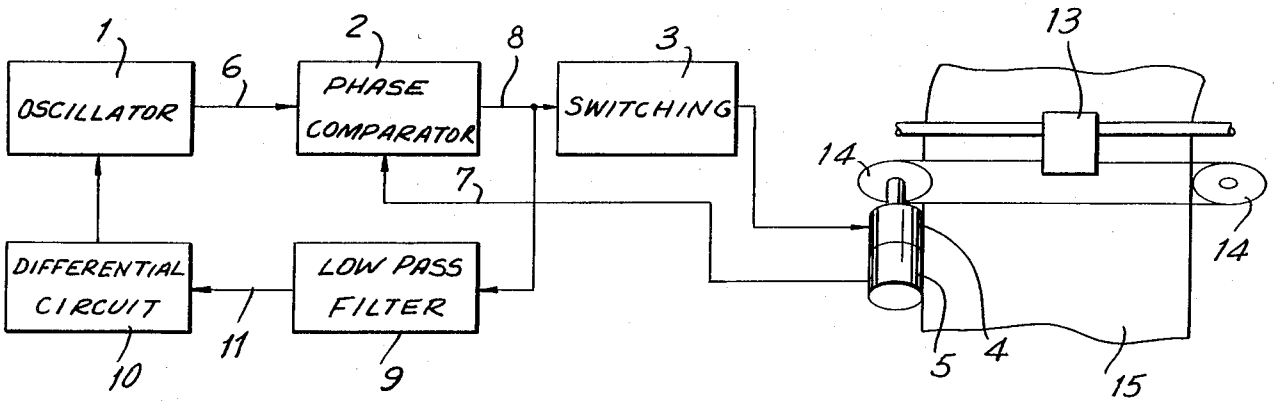
FIG. 10 is a block diagram of a phase-lock loop control device with an added acceleration feedback loop.

Reference is made to FIG. 10 wherein a block diagram of a carriage driving system utilizing a DC motor with a simple circuit that improves stability of and suppresses oscillation of a carriage control device without decreasing loop gain is depicted. A phase difference signal 8, detected by a phase comparator 2 is converted into an analog speed signal 11 through a low pass filter 9 and further converted into a psuedo-acceleration signal 12 by a differentiating circuit 10. Pseudo-acceleration signal 12 is used to frequency modulate the output signal of a reference oscillator 1.

The control system has an effect similar to that obtained by a speed control device formed by an analog circuit with an acceleration feedback loop so that the effective stability of the system is enhanced without decreasing its response property and maintaining the high degree of accuracy inherent in phase-lock loop type control devices.

Figure 9:
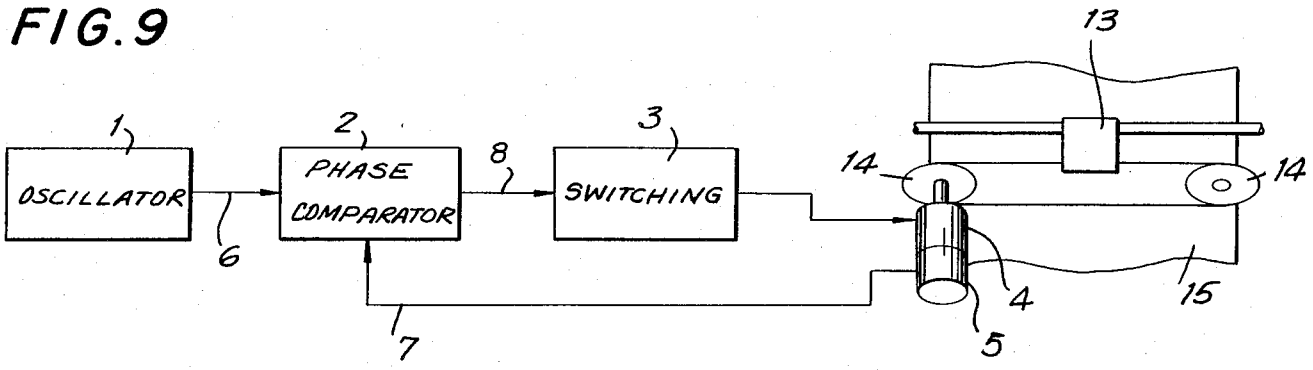
FIG. 9 is a block diagram of a conventional phase-locked loop type control devices of FIGS. 9 and 10.
Figure 11A:
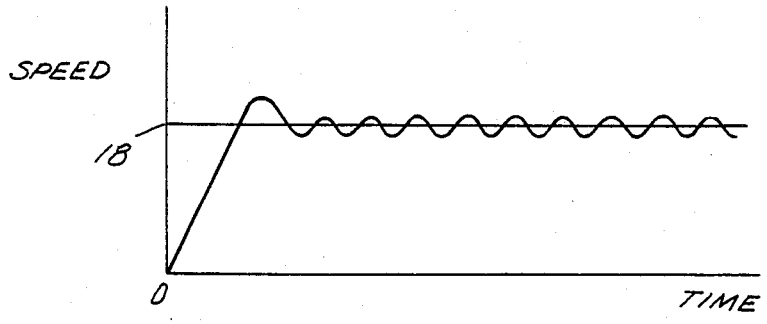
FIGS. 11A and 11B are graphs showing response characteristics of the phase-locked loop type control device.
Figure 11B:
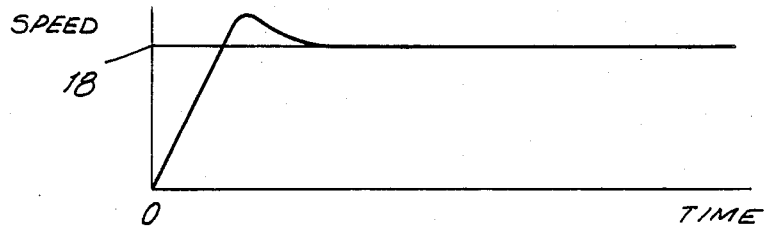

Reference is made to FIG. 11A, and 11B wherein the response properties of the phase-locked loop control device illustrated in FIGS. 9 and 10, respectively, are depicted. In these figures, lines 18 indicate a set speed and the characteristic curve 17 represents the response obtained when a signal corresponding to set speed 18 is applied at a time "0" while the carriage is in a stopped state.

In the carriage control circuit of the serial printer the actual print speed can be increased by skipping the non-print interval at a high speed or moving the carriage at a high speed up to a subsequent print start position after the printing of one line has terminated.

Figure 12:
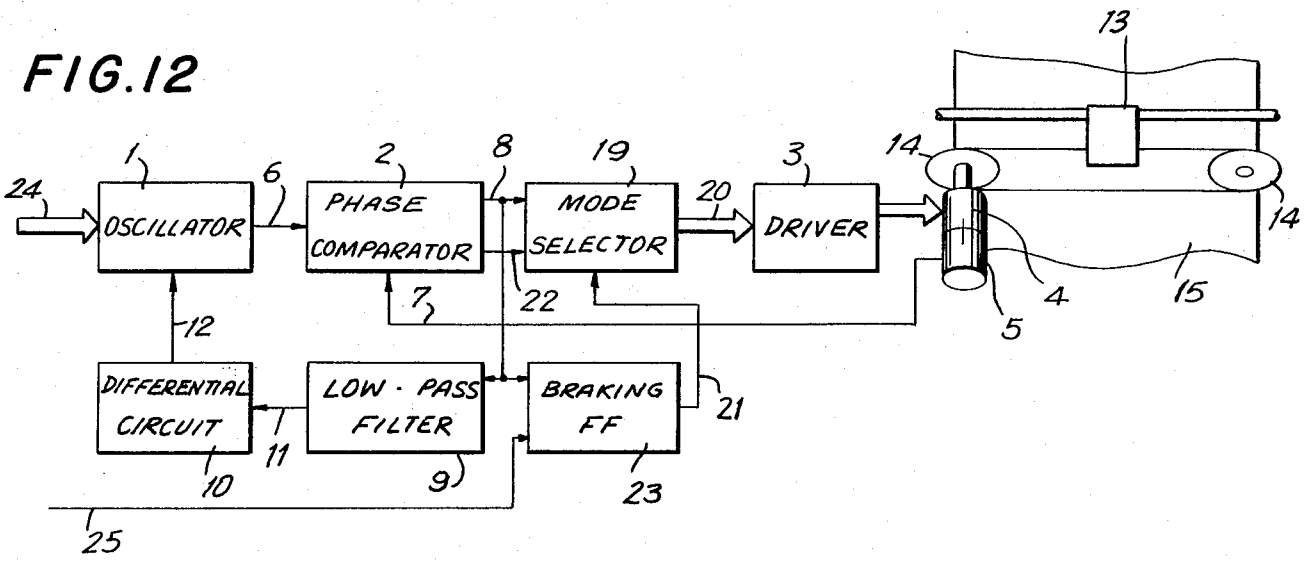
FIG. 12 is a block diagram of a carriage control device constructed in accordance with the present invention.

Reference is next made to FIG. 12 wherein a motor controller for a printer carriage which improves the response property when the set speed is decreased by using a simple circuit is depicted. The arrangement of FIG. 12 is formed by adding a mode selector circuit 19 to the system of FIG. 10 in which an input signal 24 is input to oscillator 1 to vary the frequency of the reference oscillator. As a result, the output frequency 6 of oscillator 1 varies if a set speed signal 24, to change the set speed, is applied. A phase leading signal 8 (when the oscillator output signal is leading in phase in comparison to encoder output signal 7) is output from a phase detector 2 if the applied set speed signal is less than the previously applied set speed signal. This signal is applied through mode selector 19 and a driver circuit 3 to a motor 4 to increased speed. The manner of control is the same as that of the arrangement shown in FIG. 10. On the other hand, if set speed signal 24 is smaller than the preceding set speed, concurrently with the change of the set speed signal, a slow-down signal 25 is applied to a brake flip-flop to set flip-flop 23. In response to output signal 21 of flip-flop 23, the control signal is switched by mode selector circuit 19 to a phase lagging signal 22 (when the oscillator output signal is lagging in phase in comparison to the encoder output signal 27), and the direction of current conduction applied to driver circuit 3 is changed to brake the motor. As the motor speed drops below the set speed, phase leading signal 8 is output and brake flip-flop 23 is reset with mode selelctor 19 being changed over. As a result, control returns to the state which existed prior to braking. Because of the reverse current conduction in the brake control mode when slow-down is indicated, response property similar in degree to that obtained at the time of speed-up is obtained.

Figure 13:
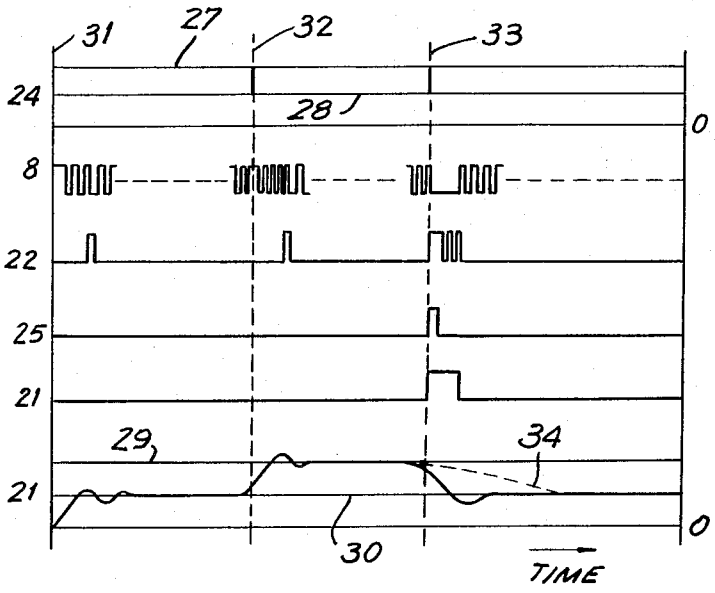
FIG. 13 is a graph showing examples of the response characteristics and signal states of a carriage control device constructed in accordance with the present invention.

FIG. 13 illustrates an example of the response characteristic when the set speed is changed. As the set speed 24 is changed from zero to a level indicated by 28 at time 31, the speed of the control device increases from level zero to level 30 as indicated by line 26. As set speed 24 is further increased to level 27, the speed 26 goes up to a level 29. Then, as set speed 24 is decreased to former level 28, the speed 26 slows down to level 30. The broken line indicated by 34 represents the speed characteristic when the mode control circuit and reverse flowing current is not present.

Figure 14:
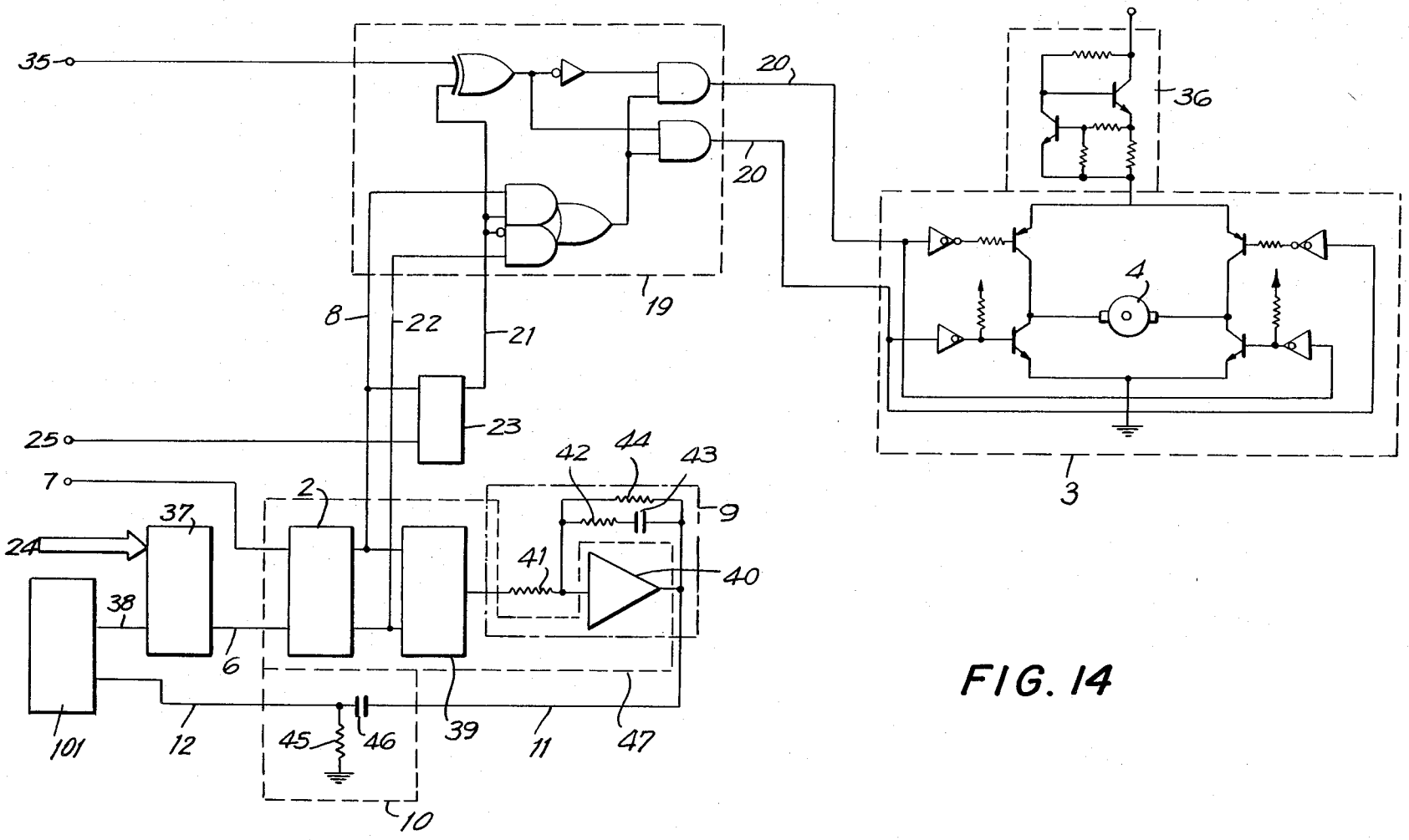
FIG. 14 is a circuit diagram of the circuit of FIG. 12.

Reference is made to FIG. 14 wherein a circuit diagram of the embodiment shown in FIG. 12 is depicted. In this drawing, a frequency modulating integrated circuit 101 performs frequency modulation by the use of acceleration signal 12. The output signal 38 of circuit 101 is frequency-divided by a programable frequency divider 37 to a frequency corresponding to set speed signal 24. The phase difference between output signal 6 of frequency divider 37 and encoder signal 7 is detected by a phase difference detector 2. A charge-discharge pump 39 is connected between phase difference detector 2 and low pass filter 9. Low pass filter 9 includes charge-discharge pump 39 and an operational amplifier 40 which converts the phase difference signal into an analog speed signal 11 which is in turn converted into acceleration signal 12 by differentiating circuit 10. The circuit portion enclosed by dotted line 47 is included in a commercially available integrated circuit which is marketed as a phase-locked loop control circuit.

A signal 35 determines the direction of movement of the carriage as indicated by 13 in FIG. 12. Mode selector circuit 19 switches between the phase leading signal 8 and the phase lagging signal 22 on the basis of signal 35 and output signal 21 of break flip-flop 23. In response to the output 20 of mode selector circuit 19, switching type driver 3, made up of four transistors, changes the direction of current conduction for the motor and its time. A current limiting circuit 36 is used to control the large current that would flow when the motor is powered in reverse during the start-up period. Circuit 36 serves to increase the lifetime of the DC motor if it is used in the carriage driving system of a serial printer or the like which requires frequent repetition of starting, stopping and reverse rotation.

The band width of low pass filter 9 is determined by a resistor 44 and a capacitor 43 set to values such that the characteristic frequency of the control system obtained by actual measurement or through computation is easily allowed to pass and sufficiently lower than the frequency of the encoder signal corresponding to the set speed. A resistor 42 to compensate for a higher range of low pass filter 9 is selected to have a resistance sufficiently smaller than resistor 44. The ratio of resistor 41 and resistor 44 becomes an adjustment parameter for a damping ratio of the control system. The product of the resistance of resistor 45 and the capacitance of capacitor 46 of differentiating circuit 10 determine the time constant of differentiating circuit 10 and are set to values so as to exert a differentiating effect on the characteristic frequency on the control system.

The term "print" when used above covers a broad range of meanings including the printing of characters, numbers, figures or other indicia. In addition, in place of the character generator, a RAM may be used to perform dump printing of characters, figure patterns and other indicia. The head may be of a type having 9, 24, 32 or more pins, other than one pin and pins arranged in a direction intersecting the direction of the printing. The present invention may be applied to any type of printer, other than the wire-dot type, such as a thermal type, heat transfer type, on-demand type or ink-jet type. Where other types of printers are used in place of the wire-dot printer, the term "pin" is more properly identified as an "electrode".

In addition, if the head has plural pins or electrodes arranged in a direction intersecting the printing direction it is possible to change the pitch in the printing direction of dots composing the characters, as well as the height of the character, by changing the angle of inclination of the head relative to the vertical direction of the recording paper. The above variations in print operation can also be realized by changing the angle between the arranged direction of pins (or electrodes) of the head and the printing direction. But, in this case, the printing timing of each dot must be taken fully into consideration and must be advanced or delayed so as to match with each dot row.

As is apparent from the foregoing description, the printer constructed in accordance with the present invention can use character patterns stored in a single character generator for printing characters with different pitches and the printer reduces the print position error by generating print timing at different pitches.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A print timing circuit for a printer having a reciprocating carriage and at least one printing element mounted on the carriage, the print timing circuit comprising: carriage control means for reciprocating said carriage; encoder means for detecting the speed of movement of the carriage and generating an encoder signal representative of the speed of movement of the carriage; oscillator means for producing a print timing signal to control operation of the printing element; frequency dividing and comparing means for dividing the encoder signal by N, where N is an integer, dividing the print timing signal by M, where M is an integer, comparing the phase relationship of the divided signals and providing and adjustment signal representative of the phase relationship of the divided signals to the oscillator means, said oscillator means being adapted to adjust a print timing signal produced thereby in response to said adjustment signal so that the print timing signal causes said print element to print at a pitch equal to a fraction M/N of a reference pitch.

2. The print timing circuit of claim 1 wherein the frequency dividing and comparing means include first and second frequency dividing means and phase difference detecting means.

3. The print timing circuit of claim 1, further comprising filter means coupled between the frequency dividing and comparing means and the oscillator means for converting the adjustment signal to an analog signal.

4. The print timing circuit of claim 2 further comprising filter means coupled between the phase difference detecting means and the oscillator means for converting the adjustment signal into an analog signal.

5. The print timing circuit of claim 2 wherein the first frequency dividing means divides the encoder signal by N and the second frequency dividing means divides the print timing signal by M.

6. The print timing circuit of claim 5 wherein the phase difference detecting means compares the phase relationship of the divided encoder and print timing signals and outputs the adjustment signal which is representative of the phase difference of the divided signals to the oscillator means.

7. The print timing circuit of claim 4 wherein the first frequency dividing means divides the encoder signal by N and the second frequency dividing means divides the print timing signal by M.

8. The print timing circuit of claim 7 wherein the phase difference detecting means compares the phase relationship of the divided encoder and print timing signals and outputs the adjustment signal which is representative of the phase difference of the divided signals to the oscillator means.

9. The print timing circuit of claim 1 further comprising supplemental dividing means for further dividing the encoder signal and the print timing signal by 2.

10. The print timing circuit of claim 9 wherein the supplemental dividing means includes two flip-flops.

11. The print timing circuit of claim 2 further comprising supplemental dividing means for further dividing the encoder signal and the print timing signal by 2.

12. The print timing circuit of claim 11 wherein the supplemental dividing means includes two flip-flops.

13. The print timing circuit of claim 1 wherein the oscillator means is a voltage controlled variable frequency oscillator.

14. The print timing circuit of claim 1 wherein the encoder means is an incremental type reference encoder.

15. The print timing circuit of claim 3 wherein the filter means comprises an RC circuit.

16. The print timing circuit of claim 1 wherein the carriage control means includes a DC motor, a driver for driving the DC motor, a phase-locked loop speed control circuit including: an encoder detecting rotational speed of the DC motor, a reference frequency modulatable oscillator outputting reference speed pulses, a phase comparator for detecting the differences phases of an output signal from the encoder and an output signal derived from the reference oscillator, the comparator outputting a phase-difference signal, and a switching circuit for switching voltage to be applied to the DC motor in response to an output signal from the phase comparator; a feedback circuit including a low pass filter converting the phase-difference signal from the phase comparator into an analog speed signal, a differentiating circuit converting the analog speed signal from the low pass filter into an acceleration signal; acceleration signal being input to the reference oscillator, the feedback circuit effecting frequency modulation of the output signal from the reference oscillator with the acceleration signal from the differentiating circuit, the modulation operation bringing the encoder and reference signals in phase, and a mode selection circuit for controlling the flow of current through the DC motor, the mode selection circuit being connected between the phase comparator and the driver; current flow in a first direction providing forward motion for the carriage, current flow in the opposite direction providing one of braking for the forward motion of the carriage and reverse motion of the carriage, the mode selection circuit being adopted to prevent braking of the forward motion when the encoder output signal is leading in phase relative to the output signal derived from the reference oscillator, the mode selection circuit causing current flow to produce forward motion of the carriage when the encoder signal lags the output signal derived from the reference oscillator.

17. The print timing circuit of claim 2 wherein the detecting means includes a bias circuit and a phase comparator.

18. The print timing circuit of claim 1 further comprising adjusting means for outputting an adjusted ouput signal, said adjusting means outputting a first print signal at a desired print start position.

19. The print timing circuit of claim 18 wherein the adjustment means includes third frequency divider means for dividing the print timing signal and divider control means for causing the third frequency dividing means to cause the frequency dividing means to divide the print timing signal by one of A, where A is an integer and N, where N is an integer.

20. The print timing circuit of claim 18 wherein the frequency dividing and comparing means divides the print timing signal by $M \times N$, where N and M are integers.

21. The print timing circuit of claim 20 whererin the adjustment means includes third frequency divider means for dividing the print timing signal and divider control means for causing the third frequency dividing means to cause the frequency dividing means to divide the print timing signal by one of A, where A is an integer and N, where N is an integer.

22. The printer of claim 1 wherein the printer is a serial dot printer.

23. The printer of claim 4 wherein the detecting means, filter means and oscillator means are analog elements.

24. The printer of claim 4 wherein the detecting means, filter means and oscillator means are numeric control elements.

25. A print timing circuit from a printer having a reciprocating carriage and at least one printing element mounted on the carriage, the print timing circuit comprising: carriage control means for reciprocating said carriage; encoder means for detecting the speed of movement of the carriage and generating an encoder signal representative of the speed of movement of the carriage; oscillator means for producing an unadjusted print timing signal; frequency dividing and comparing means for dividing the encoder signal by N, where N is an integer, dividing the unadjusted print timing signal by $M \times N$, where M and N are integers, comparing the phase relationship of the divided signals and providing an adjustment signal representative of the phase relationship of the divided signals to the oscillator means, said oscillator means being adapted to output an unadjusted print timing signal; and initiating means for outputting an adjusted print timing signal which causes the print element to print at a pitch equal to a fraction M/N of a reference pitch beginning at a desired print location.

* * * * *